US009128425B2

(12) United States Patent
Suzuki et al.

(10) Patent No.: US 9,128,425 B2
(45) Date of Patent: Sep. 8, 2015

(54) FIXING DEVICE HAVING END-FACE RESTRICTING MEMBERS APPLIED WITH LUBRICANT

(71) Applicants: Noboru Suzuki, Komaki (JP); Kei Ishida, Nagoya (JP); Takuji Matsuno, Ichinomiya (JP)

(72) Inventors: Noboru Suzuki, Komaki (JP); Kei Ishida, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/736,239

(22) Filed: Jan. 8, 2013

(65) Prior Publication Data

US 2013/0322937 A1 Dec. 5, 2013

(30) Foreign Application Priority Data

May 31, 2012 (JP) ..... 2012-124780

(51) Int. Cl.
*G03G 15/20* (2006.01)

(52) U.S. Cl.
CPC ..... *G03G 15/2003* (2013.01); *G03G 15/2053* (2013.01); *G03G 15/2017* (2013.01); *G03G 2215/2035* (2013.01)

(58) Field of Classification Search
CPC ..... G03G 2215/00151; G03G 15/2003; G03G 15/2017; G03G 15/2053; G03G 2215/2035
USPC ..... 399/122, 329; 184/15.1
See application file for complete search history.

(56) References Cited

U.S. PATENT DOCUMENTS

| | | | | | |
|---|---|---|---|---|---|
| 5,752,149 | A * | 5/1998 | Yuza et al. | ..... | 399/329 |
| 5,810,526 | A * | 9/1998 | Hirai | ..... | 409/131 |
| 6,961,532 | B2 * | 11/2005 | Uekawa et al. | ..... | 399/329 |
| 8,068,778 | B2 * | 11/2011 | Kaino et al. | ..... | 399/329 |
| 8,290,416 | B2 * | 10/2012 | Kim | ..... | 399/329 |
| 2007/0178296 | A1 * | 8/2007 | Miekka | ..... | 428/305.5 |
| 2011/0081174 | A1 * | 4/2011 | Baba | ..... | 399/329 |

FOREIGN PATENT DOCUMENTS

| | | | |
|---|---|---|---|
| JP | 04-081787 | A | 3/1992 |
| JP | 2004144833 | A * | 5/2004 |
| JP | 2008-275755 | A | 11/2008 |

OTHER PUBLICATIONS

Machine Translation of Kobayashi, Shinsuke. Heating Device, Nov. 13, 2008. Japanese Patent Office. JP2008-275755.*

* cited by examiner

*Primary Examiner* — Clayton E LaBalle
*Assistant Examiner* — Trevor J Bervik
(74) *Attorney, Agent, or Firm* — Banner & Witcoff, Ltd.

(57) ABSTRACT

A fixing device includes: a flexible tubular member defining an axis extending in an axial direction; a first fixing member; a second fixing member configured to nip the tubular member in cooperation with the first fixing member; and a pair of restricting members disposed to interpose the tubular member therebetween in the axial direction. The tubular member has end faces in the axial direction and a circumference defining a circumferential direction. Each restricting member has a restricting surface abuttable with each end face of the tubular member to restrict the tubular member from moving in the axial direction, each restricting surface having a specific area continuously applied with a lubricant upon completion of assembly of the fixing device, the specific area having an arcuate shape extending in the circumferential direction and having a width at least equal to a thickness of the tubular member in the radial direction.

15 Claims, 10 Drawing Sheets

FIXING DEVICE HAVING END-FACE RESTRICTING MEMBERS APPLIED WITH LUBRICANT

CROSS REFERENCE TO RELATED APPLICATION

This application claims priority from Japanese Patent Application No. 2012-124780 filed May 31, 2012. The entire content of the priority application is incorporated herein by reference.

TECHNICAL FIELD

The present invention relates to a fixing device for thermally fixing a developing agent image onto a sheet.

BACKGROUND

There has been proposed a fixing device that includes a tubular fusing film whose inner peripheral surface is guided by a guide member, a pressure roller configured to nip the fusing film in cooperation with the guide member, and a flange configured to restrict end faces of the fusing film. The flange serves to restrict the fusing film from moving in a longitudinal direction thereof.

SUMMARY

In such a fixing device, a lubricant such as grease is often applied between an end face of a fusing film (tubular member) and a flange (end-face restricting member). However, when the lubricant is applied in a dot-like pattern, the end face of the tubular member and the end-face restricting member may directly abut against each other. Under such circumstances, it is likely that the end-face restricting member may end with up a rough surface (with irregularity) due to attrition caused by the direct sliding contact between the end-face restricting member and the end face of the circularly-moving tubular member. As a result, the end face of the tubular member may be damaged due to its direct contact with the rough surface of the end-face restricting member. A crack or split would possibly result on the damaged end face of the tubular member.

Thus, it is an object of the present invention to provide a thermal fixing device capable of providing prolonged service life of the tubular member.

In order to attain the above and other objects, there is provided a fixing device for thermally fixing a developing agent image to a sheet, the fixing device including: a flexible tubular member; a first fixing member; a second fixing member; and a pair of restricting members. The flexible tubular member has an inner peripheral surface defining an internal space, the flexible tubular member being circularly movable while the developing agent image is thermally fixed, the flexible tubular member defining an axis extending in an axial direction and having end faces in the axial direction, the flexible tubular member having a circumference defining a circumferential direction and having a thickness in a radial direction perpendicular to the axial direction. The first fixing member is disposed at the internal space, and the second fixing member is configured to nip the flexible tubular member in cooperation with the first fixing member. The restricting members are disposed to interpose the flexible tubular member therebetween in the axial direction, each restricting member having a restricting surface abuttable with each end face of the flexible tubular member to restrict the flexible tubular member from moving in the axial direction, each restricting surface having a specific area applied with a lubricant in a continuous manner when assembly of the fixing device has been completed, the specific area having an arcuate shape extending in the circumferential direction and having a width at least equal to the thickness of the flexible tubular member in the radial direction.

According to another aspect of the present invention, there is provided a method for producing a fixing device for thermally fixing a developing agent image to a sheet. The fixing device includes: a flexible tubular member having an inner peripheral surface defining an internal space, the flexible tubular member being circularly movable while the developing agent image is thermally fixed, the flexible tubular member defining an axis extending in an axial direction and having end faces in the axial direction, the flexible tubular member having a circumference defining a circumferential direction; a first fixing member disposed at the internal space; a second fixing member configured to nip the flexible tubular member in cooperation with the first fixing member; and a pair of restricting members disposed to interpose the flexible tubular member therebetween in the axial direction, each restricting member having a restricting surface abuttable with each end face of the flexible tubular member to restrict the flexible tubular member from moving in the axial direction. The method includes: applying a lubricant onto the restricting surfaces in a continuous manner such that the lubricant extends along the circumferential direction of the flexible tubular member; and positioning each restricting surface to confront each end face of the flexible tubular member in the axial direction, the positioning being executed after the applying.

DETAILED DESCRIPTION

First, a general construction of a laser printer 1 that is provided with a fixing device 100 according to an embodiment of the present invention will be described with reference to FIG. 1. Then, a detailed configuration of the fixing device 100 will be described with reference to FIGS. 2-9C.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

<General Construction of the Laser Printer>

Figure 1:
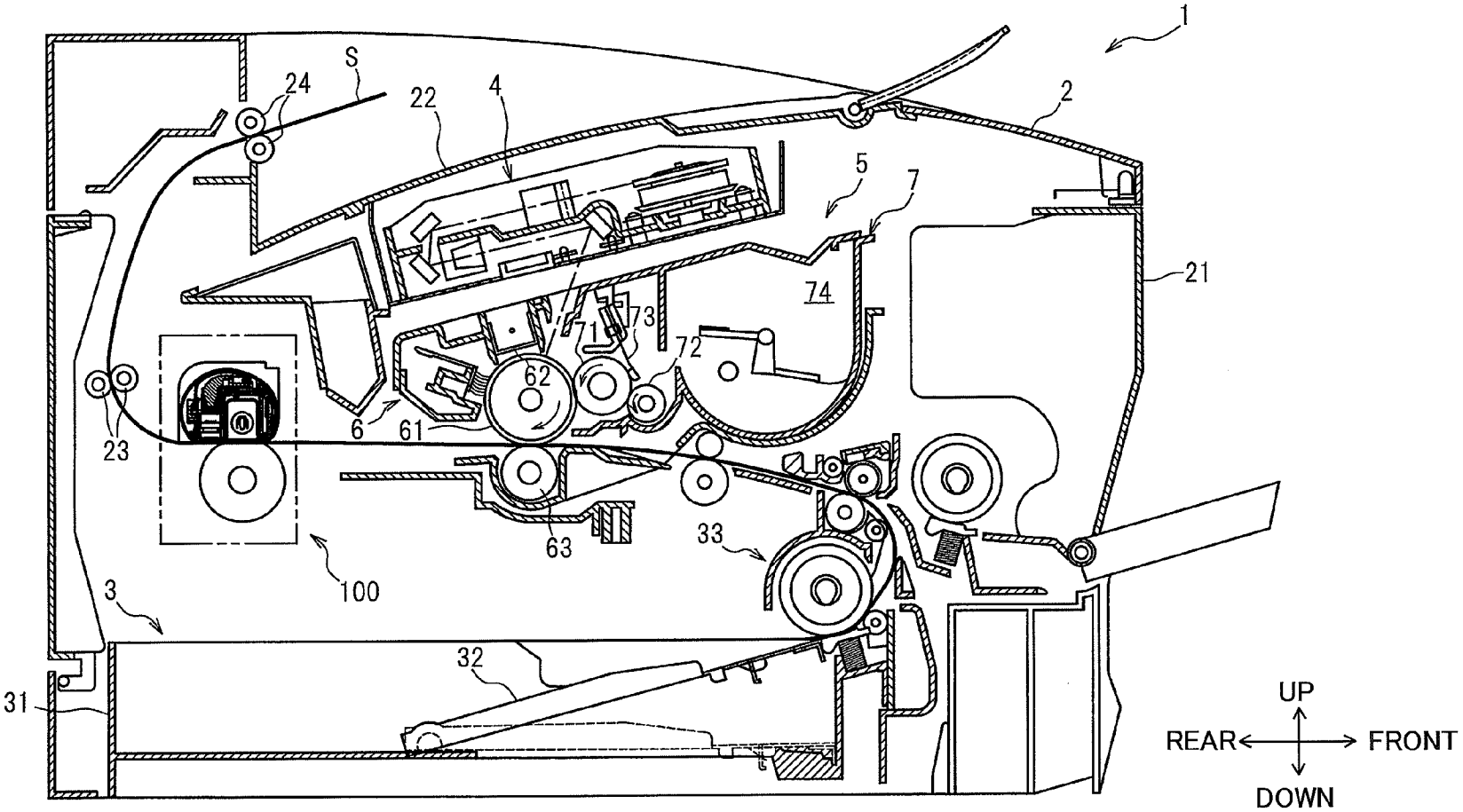
FIG. 1 is a schematic cross-sectional view of a laser printer having a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S and a sheet supplying mechanism 33. Each sheet S accommodated in the sheet supply tray 31 is directed upward by the lifter plate 32 and supplied toward the process cartridge 5 (between a photosensitive drum 61 and a transfer roller 63) by the sheet supplying mechanism 33. A path along which the sheet S is conveyed within the main frame 2 (sheet conveying path) is shown by a thick solid line in FIG. 1.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data. A surface of the photosensitive drum 61 is exposed to light by the laser beam at a high speed.

The process cartridge 5 is disposed below the exposure unit 4. The process cartridge 5 is detachably loadable in the main frame 2 through an opening defined when the front cover 21 of the main frame 2 is opened.

The process cartridge 5 includes a drum unit 6 and a developing unit 7.

The drum unit 6 includes the photosensitive drum 61, a charger 62, and the transfer roller 63. The developing unit 7 is detachably mountable on the drum unit 6 and includes a developing roller 71, a supply roller 72, a thickness-regulation blade 73, and a toner accommodating portion 74 in which toner (developer) is accommodated.

In the process cartridge 5, after the surface of the photosensitive drum 61 is uniformly charged by the charger 62, the surface is exposed to the high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 and is carried on the developing roller 71 as a thin layer having a uniform thickness.

The toner borne on the developing roller 71 is supplied to the electrostatic latent image formed on the photosensitive drum 61, thereby forming a visible toner image on the surface of the photosensitive drum 61. Then, the sheet S is conveyed between the photosensitive drum 61 and the transfer roller 63, so that the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image is thermally fixed is then conveyed by conveying rollers 23 and 24, and discharged onto a discharge tray 22 formed on an upper surface of the main frame 2.

<Detailed Structure of the Fixing Device>

Next, a detailed structure of the fixing device 100 will be described with reference to FIGS. 2 to 7.

Figure 2:
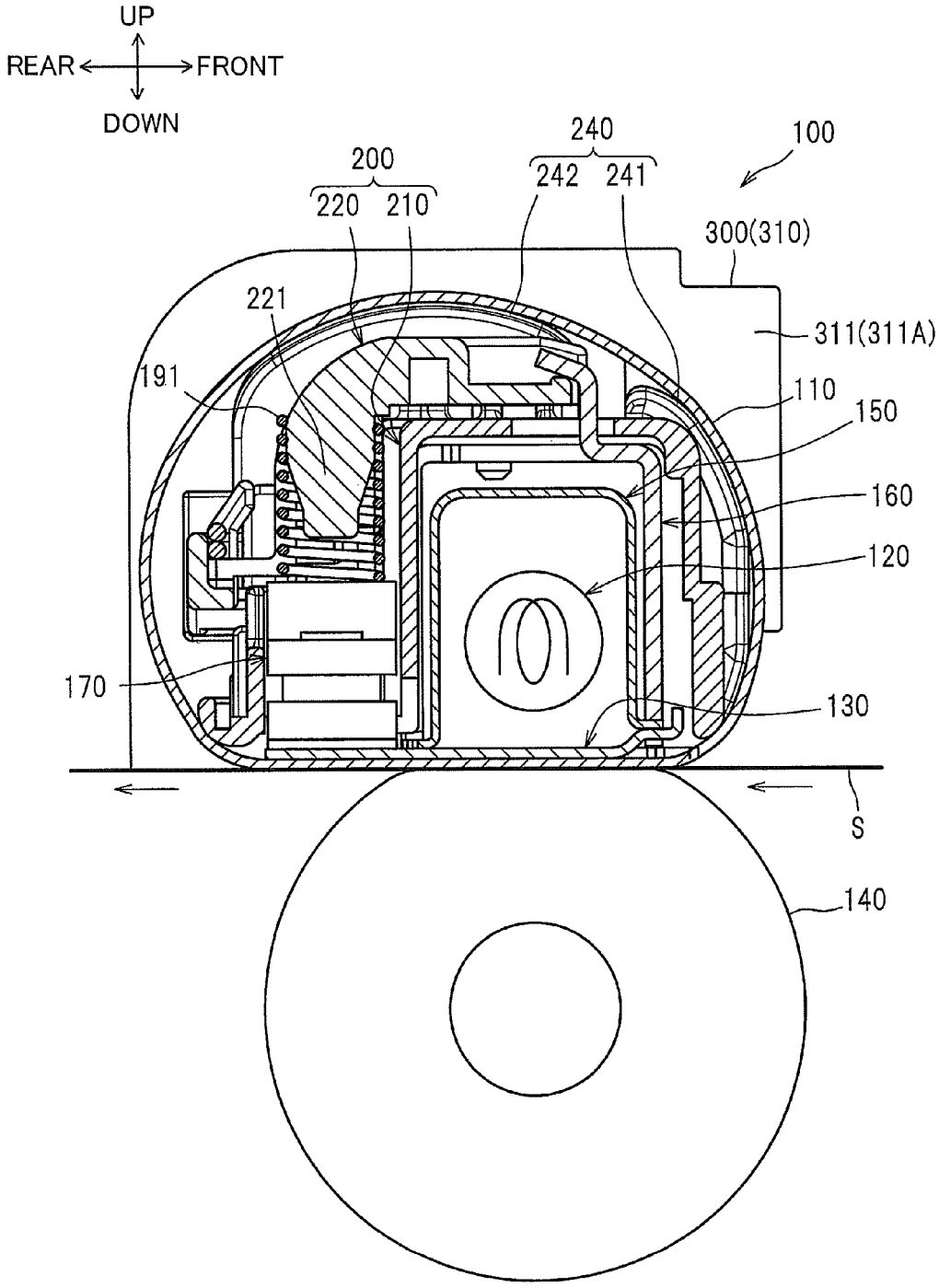
FIG. 2 is an enlarged schematic cross-sectional view showing a structure of the fixing device according to the embodiment.
Figure 3:
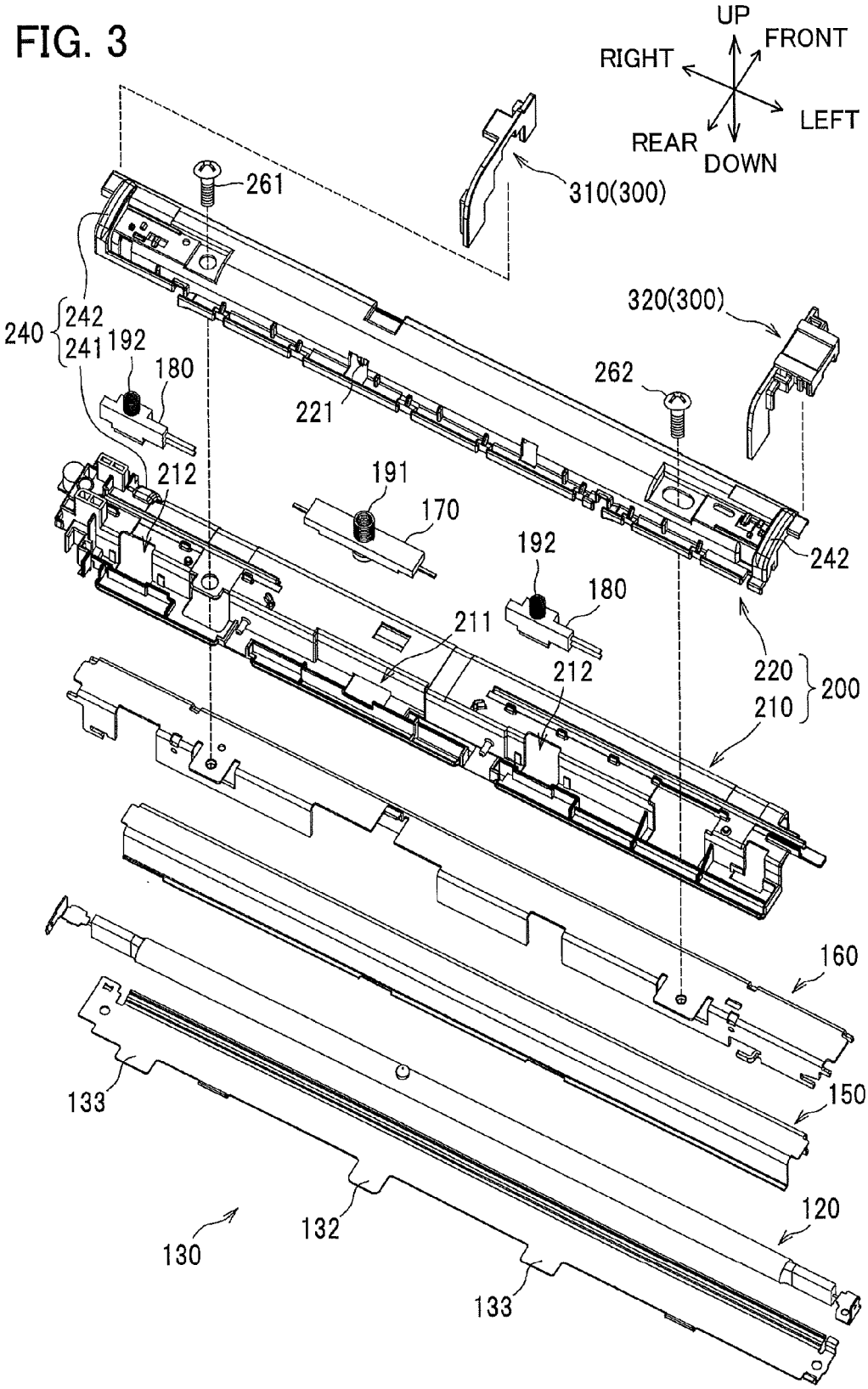
FIG. 3 is an exploded perspective view of the fixing device according to the embodiment, the fixing device including a right end-face restricting member, a left end-face restricting member 320, and a frame assembly.

As shown in FIGS. 2 and 3, the fixing device 100 includes a flexible fusing belt 110 as a tubular member, a halogen lamp 120 as a heater, a nip plate 130 as a first fixing member, a backup roller 140 as a second fixing member, a reflection member 150, a stay 160, a thermostat 170, two thermistors 180, a frame assembly 200, a pair of end-face restricting members 300 (a right end-face restricting member 310 and a left end-face restricting member 320).

The fusing belt 110 is of an endless belt (of a tubular configuration) having heat resistivity and flexibility. The fusing belt 110 has an inner peripheral surface that defines an internal space within which the halogen lamp 120, the nip plate 130, the reflection member 150, the stay 160 and the frame assembly 200 are disposed. The fusing belt 110 extends in a left-to-right direction. Hereinafter, the left-to-right direction in which the fusing belt 110 extends may also be referred to as an axial direction of the fusing belt 110, wherever necessary. The fusing belt 110 has widthwise end portions in the axial direction that are guided by inner guides 240 (described later) so that the fusing belt 110 is circularly movable therealong.

Figure 7:
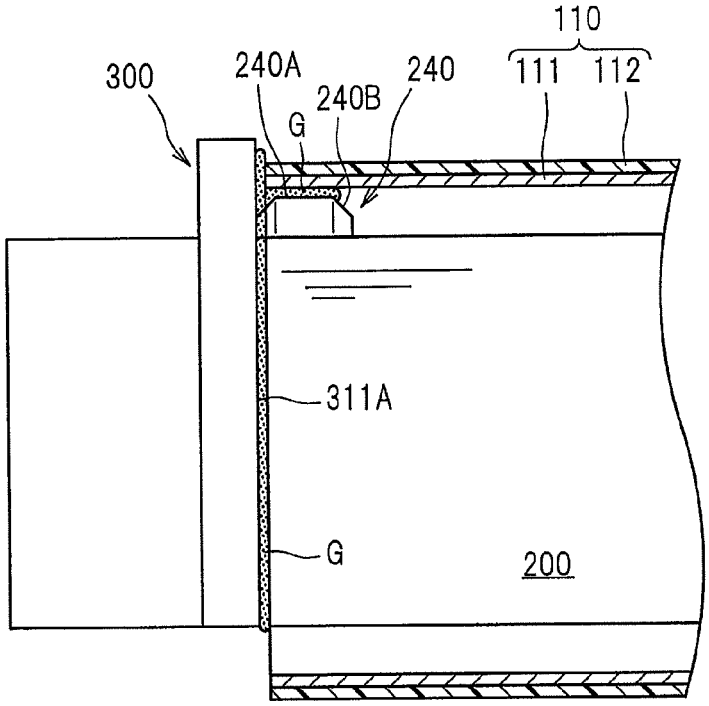
FIG. 7 is an explanatory view illustrating technical advantages of inner guides formed adjacent to the end-face restricting members.

In the embodiment, as shown in FIG. 7, the fusing belt 110 is configured of a base tube 111, and a coating layer 112 formed on an outer peripheral surface of the base tube 111. The base tube 111 is made of a metal such as stainless steel, and the coating layer 112 is made of a fluorine resin. The coating layer 112 covers the entire outer peripheral surface of the base tube 111, but both widthwise end faces of the base tube 111 (only one is shown in FIG. 7) are exposed outside in the axial direction. The fusing belt 110 therefore has a predetermined thickness in a radial direction thereof.

The halogen lamp 120 is a heater to generate radiant heat to heat the nip plate 130 and the fusing belt 110 for heating toner on the sheet S. The halogen lamp 120 is positioned at the internal space of the fusing belt 110 such that the halogen lamp 120 is spaced away from an inner surface of the nip plate 130 by a predetermined distance, as shown in FIG. 2.

The nip plate 130 has a plate-like shape and is adapted to receive radiant heat from the halogen lamp 120. To this effect, the nip plate 130 is positioned at the internal space of the fusing belt 110 such that the inner peripheral surface of the fusing belt 110 is slidably movable with a lower surface of the nip plate 130. The nip plate 130 is made from a metal. In the embodiment, the nip plate 130 is made of aluminum having a relatively high thermal conductivity. The nip plate 130 has a rear edge portion from which three protruding portions 132, 133 protrude rearward, as shown in FIG. 3.

The backup roller 140 is disposed below the nip plate 130 such that the backup roller 140 nips the fusing belt 110 in cooperation with the nip plate 130, as shown in FIG. 2, to convey the sheet S.

The backup roller 140 is configured to rotate upon receipt of a driving force transmitted from a motor (not shown) disposed within the main frame 2. As the backup roller 140 rotates, the fusing belt 110 is circularly moved along the nip plate 130 because of a friction force generated between the back-up roller 140 and the fusing belt 110 or between the sheet S and the fusing belt 110. The toner image on the sheet S can be thermally fixed thereto by heat and pressure during passage of the sheet S between the backup roller 140 and the fusing belt 110.

The reflection member 150 is adapted to reflect radiant heat from the halogen lamp 120 toward the nip plate 130. As shown in FIG. 2, the reflection member 150 is positioned at the internal space of fusing belt 110 to surround the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray.

The stay 160 is adapted to support the nip plate 130 via the reflection member 150. The stay 160 is thus adapted to receive pressure (load) applied from the backup roller 140 to maintain rigidity of the nip plate 130. The stay 160 is disposed at the internal space of the fusing belt 110 so as to cover the halogen lamp 120 and the reflection member 150. For fabricating the stay 160, a highly rigid member such as a steel plate is folded into U-shape.

The thermostat 170 and the thermistors 180 are configured to detect a temperature of the nip plate 130. Each of the thermostat 170 and the thermistors 180 has a lower surface serving as a temperature detecting surface. As shown in FIG. 2, the thermostat 170 and the thermistors 180 are disposed at the internal space of the fusing belt 110 such that lower surfaces of the thermostat 170 and the thermistors 180 oppose upper surfaces of the protruding portions 132, 133 of the nip plate 130 respectively. The thermostat 170 and the thermistors 180 are respectively biased toward the protruding portions 132, 133 by coil springs 191, 192. With this construction, the thermostat 170 and the thermistors 180 are stably positioned relative to the nip plate 130. Hence, the thermostat 170 and the thermistors 180 can detect the temperature of the nip plate 130 with accuracy.

The thermostat 170 is connected to the halogen lamp 120 and is configured to shut off power supply to the halogen lamp 120 upon detection of a predetermined temperature. The thermistors 180 are configured to output detected temperatures to a control circuit (not shown) provided in the main frame 2 for controlling the halogen lamp 120 (temperature of the fixing device 100).

The frame assembly 200 is adapted to support the thermostat 170, the thermistors 180 and the end-face restricting members 300. The frame assembly 200 is disposed at the internal space of the fusing belt 110 so as to cover the stay 160, as shown in FIG. 2.

The frame assembly 200 includes a first frame member 210 and a second frame member 220, as shown in FIG. 3.

The first frame member 210 extends in the left-to-right direction and has a substantially U-shaped cross-section so as to cover the stay 160. The first frame member 210 is formed with a first positioning portion 211 and two second positioning portions 212. The first positioning portion 211 is adapted to be coupled with the thermostat 170, while the second positioning portions 212 are adapted to be coupled with the thermistors 180. The thermostat 170 and the thermistors 180 are thus positioned in the front-to-rear direction as well as in the left-to-right direction.

As shown in FIGS. 2 and 3, the second frame member 220 has a substantially L-shaped cross-section and extends in the left-to-right direction to cover the first frame member 210. The second frame member 220 has an upper wall on which three supporting portions 221 (only one is shown in FIG. 3) are formed. Specifically, each supporting portion 221 has a boss-like shape protruding downward from a lower surface of the upper wall of the second frame member 220 for supporting one of the coil springs 191, 192. The coil springs 191, 192 are engaged with respective supporting portions 221 such that the coil springs 191, 192 are interposed between the upper wall of the second frame member 220 and the thermistor 170 or the thermistors 180 in a compressed state.

The first frame member 210 and the second frame member 220 are fixed to the stay 160 by screws 261, 262 in a state where cables connecting between the halogen lamp 120 and the thermistor 170 (not shown) are interposed between the first frame member 210 and the second frame member 220.

As shown in FIGS. 4A through 5B, the frame assembly 200 has left and right end portions on each of whose outer surface the inner guide 240 and a mounting portion 250 are formed.

The inner guides 240 are adapted to be in sliding contact with the inner peripheral surface of the fusing belt 110 to guide the circular movement of the fusing belt 110 (also see FIG. 2). Each inner guide 240 is configured of a first guide 241 formed on the first frame member 210 and a second guide 242 formed on the second frame member 220 (also see FIG. 3).

Each first guide 241 is formed on each widthwise end portion of the first frame member 210 to protrude generally frontward therefrom (toward the inner peripheral surface of the fusing belt 110) and has an arcuate shape in a side view.

Each second guide 242 is formed on each widthwise end portion of the second frame member 220 to protrude generally upward therefrom (toward the inner peripheral surface of the fusing belt 110) and has an arcuate shape in a side view.

Each inner guide 240 (the first guide 241 and second guide 242 as assembled) is formed with a guide surface 240A and two sloped surfaces 240B (also see FIG. 7, 8). The guide surface 240A extends in a direction substantially parallel to the inner peripheral surface of the fusing belt 110 so as to guide the same. Each sloped surface 240B extends from the guide surface 240A either leftward or rightward and slopes toward the upper wall of the second frame member 220 (or in a direction away from the inner peripheral surface of the fusing belt 110 and the guide surface 240A).

Each mounting portion 250 is adapted to be engaged with each end-face restricting member 300 (the right end-face restricting member 310 or the left end-face restricting member 320). Each mounting portion 250 is arranged outward (rightward or leftward) of the corresponding inner guide 240 in the left-to-right direction. In other words, in the present embodiment, each inner guide 240 is provided laterally inward of and adjacent to each end-face restricting member 300 mounted on the frame assembly 200 in the left-right direction.

The pair of end-face restricting members 300 serves to restrict position of the fusing belt 110 in the axial direction. The end-face restricting members 300 include the right end-face restricting member 310 for restricting a right end face of the fusing belt 110, and the left end-face restricting member 320 for restricting a left end face of the fusing belt 110.

Figure 4A:
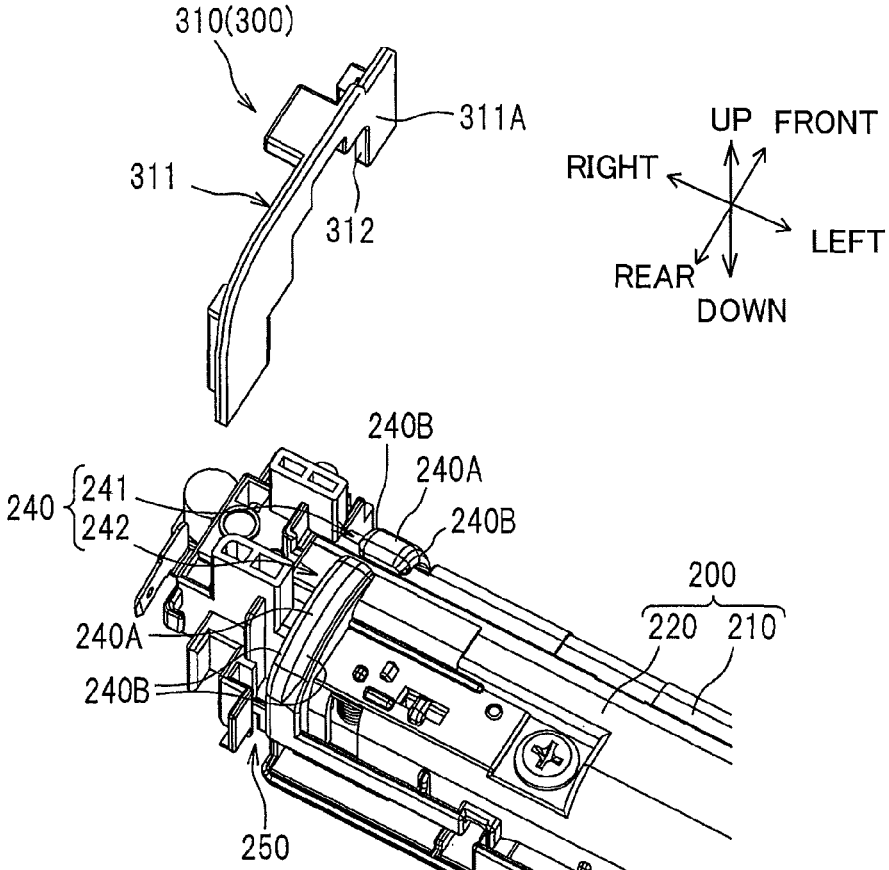
FIG. 4A is a view showing a state where the right end-face restricting member is removed from the frame assembly.
Figure 4B:
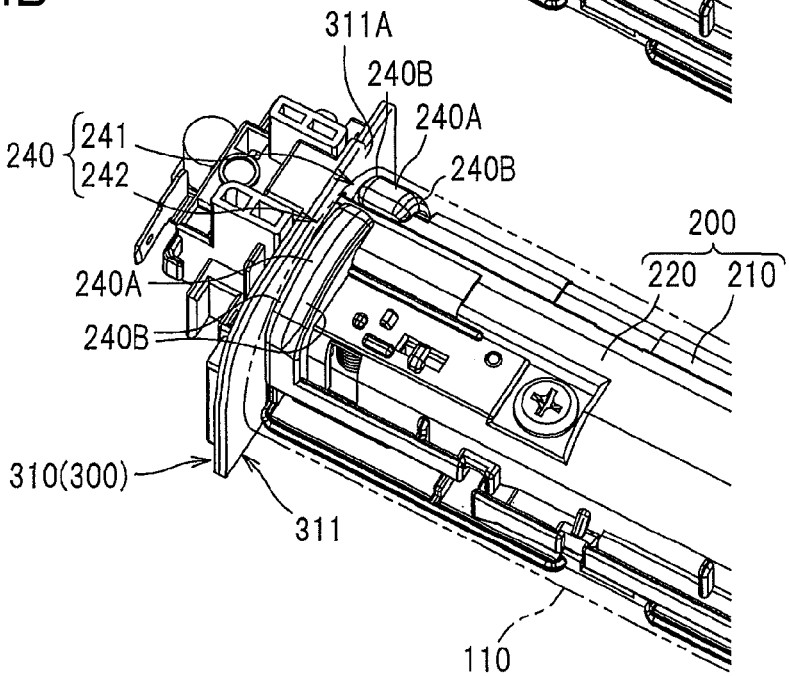
FIG. 4B is a view showing a state where the right end-face restricting member has been assembled to the frame assembly.
Figure 5A:
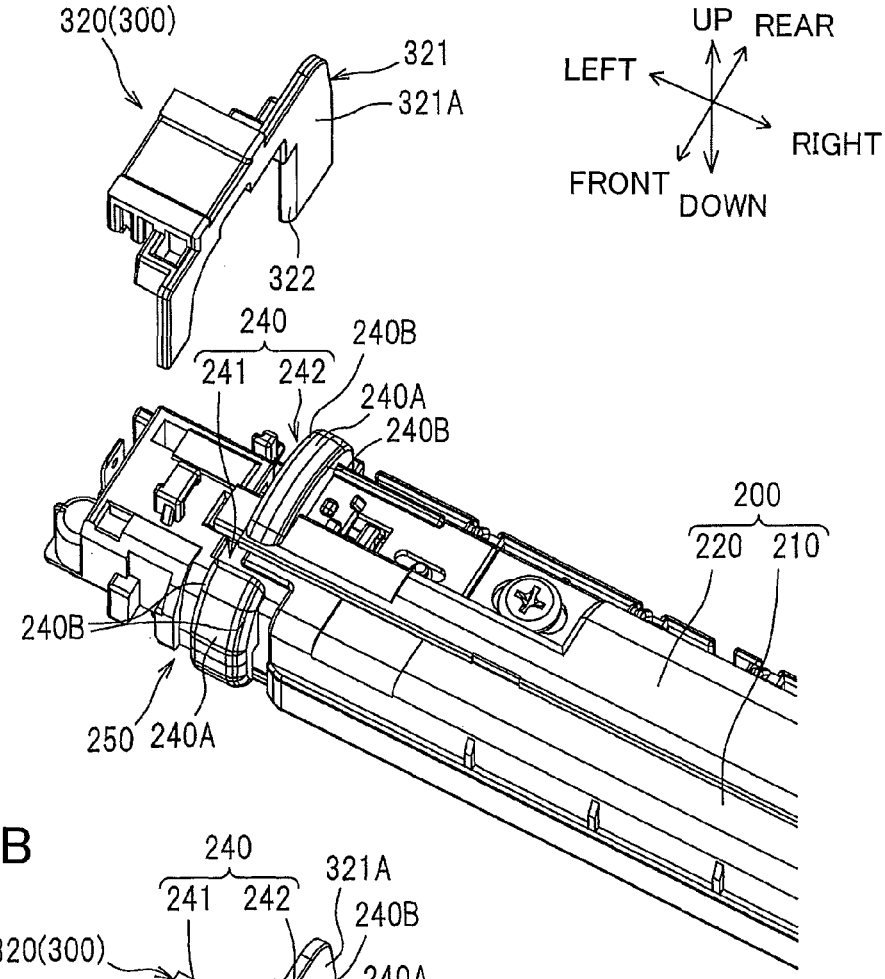
FIG. 5A is a view showing a state where the left end-face restricting member is removed from the frame assembly.
Figure 5B:
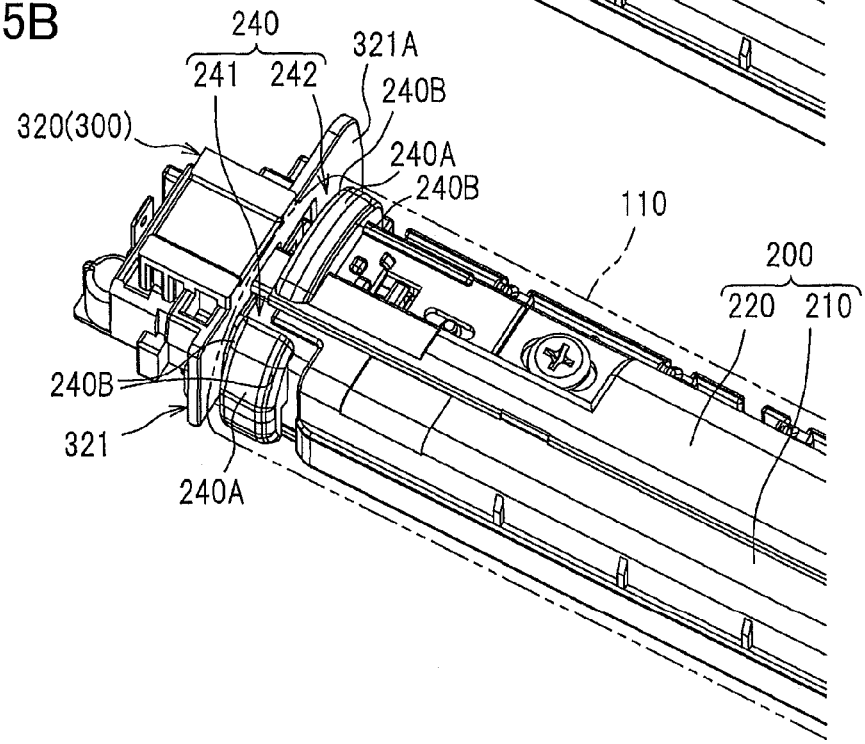
FIG. 5B is a view showing a state where the left end-face restricting member has been assembled to the frame assembly.

The right end-face restricting member 310 includes a plate-like shaped restricting portion 311 and an engaged portion 312, as shown in FIG. 4A, whereas the left end-face restricting member 320 includes a plate-like shaped restricting portion 321 and an engaged portion 322, as shown in FIG. 5A. The engaged portions 312 and 322 are formed so as to be recessed upward from lower ends of the restricting portions 311 and 321, respectively.

The restricting portion 311 has a left surface 311A that is abuttable with the right end face of the fusing belt 110 as the fixing device 100 circularly moves. The restricting plate 321 has a right surface 321A that is abuttable with the left end face of the fusing belt 110 as the fixing device 100 circularly moves. Thus, the left surface 311A of the restricting portion 311 and the right surface 321A of the restricting portion 321 respectively serve as restricting surfaces 311A, 321A for restricting the fusing belt 110 (the right and left end faces of the fusing belt 110) from moving in the axial direction. The restricting surfaces 311A and 321A are formed as a flat surface without irregularities. It should be noted that, in the embodiment, "a flat surface without irregularities" means neither the restricting surface 311A nor the restricting surface 321A is integrally formed with any protruding portions, for example, for guiding the inner peripheral surface or outer peripheral surface of the fusing belt 110.

Figure 6A:
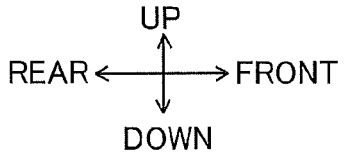
FIG. 6A is a plan view of a restricting surface of the right end-face restricting member.
Figure 6A:
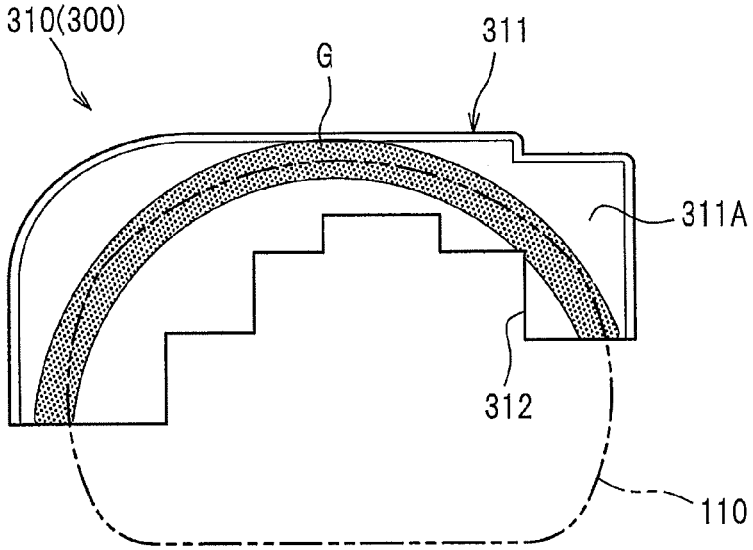
Figure 6B:
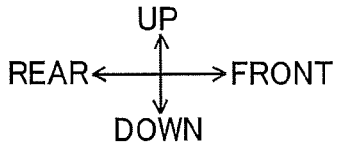
FIG. 6B is a plan view of a restricting surface of the left end-face restricting member.
Figure 6B:
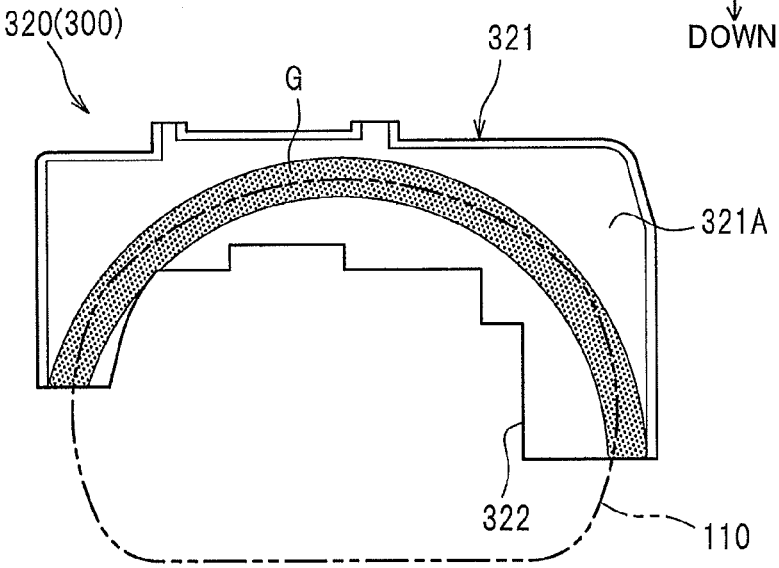

As illustrated in FIGS. 6A and 6B, a lubricant G is applied onto the restricting surfaces 311A and 321A. More specifically, the lubricant G is continuously applied in a specific area on each of the restricting surfaces 311A and 321A, the specific area having an arcuate shape extending along a circumferential direction of the fusing belt 110. That is, the right and left end-face restricting members 310, 320 are formed with the specific area which is completely and evenly covered with the lubricant G in its entirety. For the purpose of preventing direct contact between each end face of the fusing belt 110 and each restricting surfaces 311A, 321A, this specific area should have a width in the radial direction at least equal to the thickness of the fusing belt 110.

Preferably, considering that the fusing belt 110 may slightly move (fluctuate) in the radial direction while the fusing belt 110 is circularly moving, the lubricant G may be continuously applied such that the width of the arcuate-shaped specific area in the radial direction spans a range within which each end face of the fusing belt 110 is possibly abuttable with corresponding restricting surface 311A or 321A during the circular movement of the fusing belt 110. More specifically, assuming that the end faces of the fusing belt 110 are possibly displaced from its innermost position and its outermost position in the radial direction during its circular movement, the width of the specific area may be set to span at least between the innermost position and the outermost position of each end face of the fusing belt 110. The width of the lubricant G in the radial direction can be appropriately set in accordance with how much the fusing belt 110 moves (displaces or fluctuates) in the radial direction. For example, the width of the lubricant G may be set to 4.0-4.5 mm. As the lubricant G, a thermally-resistant fluorine grease is available, for example.

In the present embodiment, when the fixing device 100 is in a brand-new state or the fixing device 100 has just been assembled, the lubricant G has already been continuously applied in the arcuate-shaped specific area extending along the circumferential direction of the fusing belt 110 on each of the restricting surfaces 311A, 321A. In other words, the lubricant G has already been applied on the restricting surfaces 311A, 321A along the circumferential direction of the fusing belt 110, before the fusing belt 110 is initially circularly moved: that is, the lubricant G is not spread by the end faces of the fusing belt 110 after the fixing device 100 is disposed in the laser printer 1.

As illustrated in FIGS. 4A through 5B, the engaged portions 312 and 322 are adapted to be engaged with the mounting portions 250 formed in the frame assembly 200. The end-face restricting members 300 are fixed to the frame assembly 200 mainly through the engagement of the engaged portions 312 and 322 with the corresponding mounting portions 250.

With the above-described configuration, following operations and technical advantages can be achieved.

As illustrated in FIG. 6, in the brand-new fixing device 100, the lubricant G has already been continuously applied between each end face of the fusing belt 110 and each of the restricting surfaces 311A and 321A in the circumferential direction of the fusing belt 110. Hence, direct abutment between the end faces of the fusing belt 110 and the restricting surfaces 311A and 321A can be prevented from the beginning of the use of the fixing device 100. Further, the lubricant G is applied in an arcuate shape having a predetermined width. Therefore, direct abutment between the end face of the fusing belt 110 and each of the restricting surfaces 311A and 321A can be prevented even if the fusing belt 110 displaces (moves) in the radial direction thereof during its circular movement. As a result, occurrence of a crack on the end faces of the fusing belt 110 can be suppressed, thereby serving to prolonged service life of the fusing belt 110.

Further, the lubricant G is applied onto the arcuate-shaped specific area on the restricting surfaces 311A and 321A within which the end faces of the fusing belt 110 are possibly abuttable against the restricting surfaces 311A and 321A. This ensures that the lubricant G is provided between each end face of the fusing belt 110 and its corresponding restricting surface 311A or 321A, thereby more reliably preventing direct abutment therebetween. Further prolonged service life of the fusing belt 110 can be therefore achieved.

The fusing belt 110 of the present embodiment has the metal base tube 111 and therefore has a durability higher than that of a resin fixing belt to achieve longer service life. On the other hand, since the both end faces of the base tube 111 are exposed (not covered with the coating layer 112), conceivably, not only the end faces of the base tube 111 but also the restricting surfaces 311A and 321A could become worn out and be damaged if the end faces directly abut against the restricting surfaces 311A and 321A. However, in the fixing device 100 of the present embodiment, continuous application of the lubricant G on the restricting surfaces 311A and 321A along the circumferential direction of the fusing belt 110 prevents direct abutment of the end faces of the fusing belt 110 with the restricting surfaces 311A and 321A. Thus, the configuration of the present embodiment is particularly effective in a configuration in which the fusing belt 110 has the metal base tube 111.

Further, in the present embodiment, the coating layer 112 made of a fluorine resin is formed on the outer peripheral surface of the base tube 111. Therefore, compared to a case where the coating layer 112 is not provided on the outer peripheral surface of the base tube 111, a contact area between each end face of the fusing belt 110 and each of the restricting surfaces 311A and 321A can be increased by the thickness of the coating layer 112. This configuration can achieve a decrease in pressure at the contact area, thereby suppressing load from being applied to the end faces of the fusing belt 110. Longer service life can be thus achieved.

Further, as illustrated in FIG. 7, the inner guides 240 are formed adjacent to and inward of the end-face restricting member 300 in the left-right direction. Therefore, as the fusing belt 110 is circularly moved, the lubricant G, which has been retained between the end faces of the fusing belt 110 and the restricting surfaces 311A, 321A (only one of which is shown), enters into the internal space of the fusing belt 110 and is supplied between the inner peripheral surface of the fusing belt 110 and the guide surfaces 240A of the respective inner guides 240. This can suppress abrasion of the inner peripheral surface of the fusing belt 110, thereby contributing to further prolongation of the service life of the fusing belt 110.

Further, in the present embodiment, the inner guides 240 and end-face restricting members 300 are provided as separate members (separate parts). Therefore, no protruding portions functioning as the inner guides 240 are necessary to be formed on the restricting surfaces 311A and 321A. In other words, the restricting surfaces 311A and 321A are easy to be formed as being flat surfaces having no irregularity, thereby allowing the lubricant G to be easily applied onto the specific areas on the restricting surfaces 311A and 321A.

<Production Method of Fixing Device>

Next, a production method of the fixing device 100 will be described. More specifically, of a series of processes to produce the fixing device 100, how to apply the lubricant G onto the restricting surfaces 311A, 321A of the end-face restricting members 300 (lubricant application process) will be described with reference to FIGS. 9A through 9C.

The lubricant application process is performed before the end faces of the fusing belt 110 and the restricting surfaces 311A and 321A of the end-face restricting member 300 are placed to face each other, specifically, before the end-face restricting members 300 are assembled to the frame assembly 200.

Figure 9A:
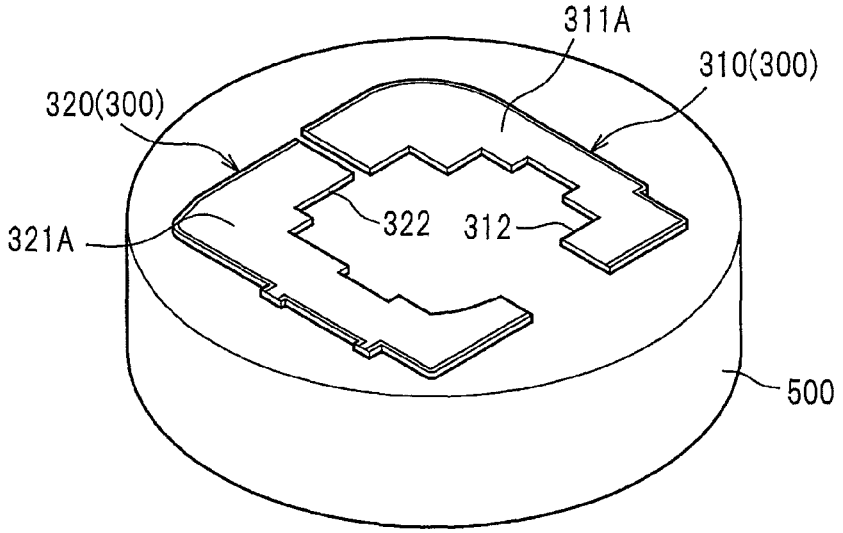
FIGS. 9A to 9C illustrate steps of a lubricant application process performed during production of the fixing device of the embodiment.

Firstly, as illustrated in FIG. 9A, the right end-face regulating member 310 and left end-face regulating member 320 are set onto a jig 500 such that the restricting surfaces 311A and 321A face upward and the engaged portions 312 and 322 oppose each other. Then, the jig 500, in which the end-face restricting members 300 (right end-face regulating member 310 and left end-face regulating member 320) have been in place, is set in a lubricant application device (not shown).

Figure 9B:
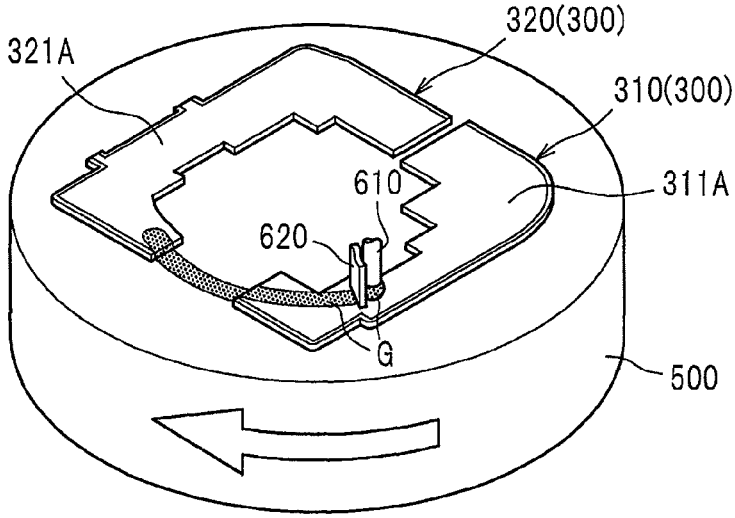

Then, as illustrated in FIG. 9B, a predetermined amount of lubricant G is supplied from a dispenser 610 of the lubricant application device (not shown) while the jig 500 is rotated in a clockwise direction in FIG. 9B. The lubricant G is thus continuously applied onto the restricting surfaces 311A and 321A so as to follow the circumferential direction of the fusing belt 110. Concurrently, the lubricant G is flattened into an arcuate shape having a predetermined width by the rotation of the jig 500 as well as by a paddle 620 disposed adjacent to and downstream of the dispenser 610 in the rotational direction of the jig 500.

Figure 9C:
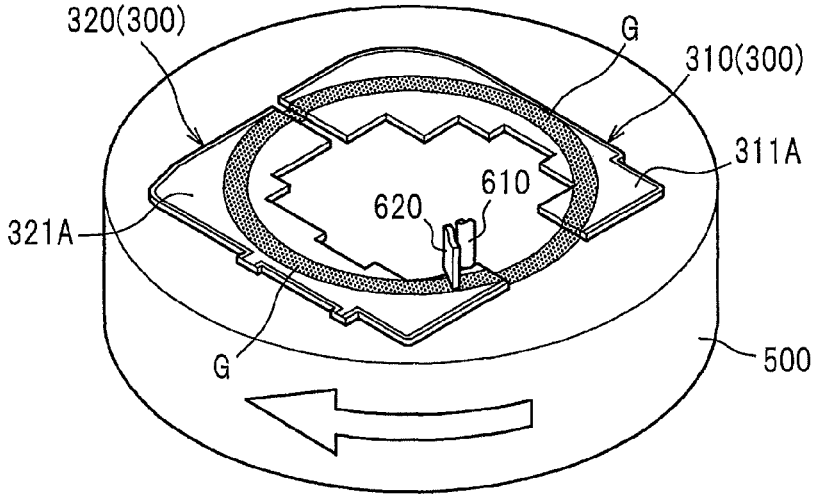

In the lubricant application process of the present embodiment, the jig 500 is rotated twice. During a first rotation, as described above, the lubricant G supplied from the dispenser 610 is continuously applied in the rotation direction, while being flattened by the paddle 620. During a second rotation, as illustrated in FIG. 9C, the lubricant G is no longer supplied from the dispenser 610, and only the paddle 620 performs flattening of the lubricant G.

After rotation of the jig 500 is stopped, the jig 500 is removed from the lubricant application device, and the end-face restricting members 300 are then removed from the jig 500.

As a result, the lubricant G is applied onto the restricting surfaces 311A and 321A of the end-face restricting members 300 in a continuous manner to form the arcuate-shaped specific areas on the restricting surfaces 311A, 321A (see also FIGS. 6A and 6B). Preferably, as described earlier, when the end-face restricting members 300 are removed from the jig 500, the restricting surfaces 311A and 321A have the lubricant G applied thereon in the arcuate-shaped specific area as a whole within which the end faces of the fusing belt 110 possibly abut against the restricting surfaces 311A and 321A.

Figure 8:
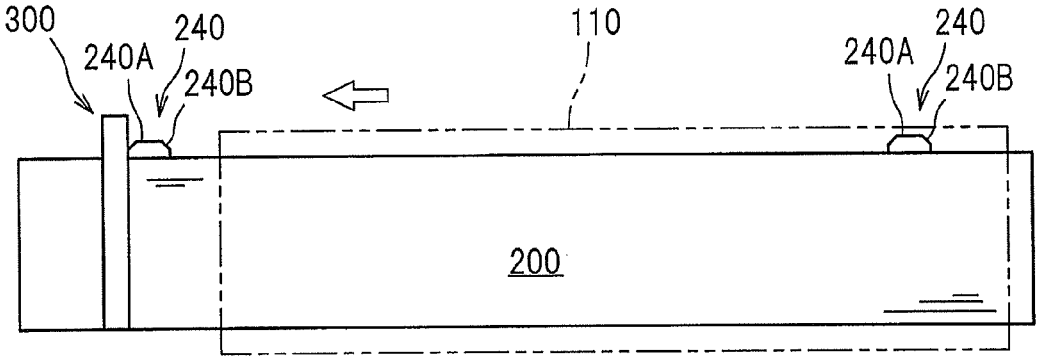
FIG. 8 is an explanatory view illustrating technical advantages of the inner guides formed with sloped surfaces.

After the lubricant application process is completed, the end-face restricting members 300 are assembled to the frame assembly 200 in an assembly process. The restricting surfaces 311A and 321A are arranged so as to face respective end faces of the fusing belt 110 in the axial direction. It should be noted that, in the assembly process, as illustrated in FIG. 8, one of the end-face restricting members 300 (either one of the right end-face regulating member 310 and left end-face regulating member 320) is first assembled to the frame assembly 200, and then the fusing belt 110 is mounted on the frame assembly 200 from a side opposite to the side at which one of the end-face restricting members 300 has been assembled. Subsequently, remaining one of the end-face restricting members 300 is assembled to the frame assembly 200. The restricting surfaces 311A and 321A are thus arranged to face the end faces of the fusing belt 110.

Further, the inner guide 240 provided on the frame assembly 200 has the slopes 240B on both left and right sides of the guide surface 240A, so that the end face of the fusing belt 110 can be guided by the slopes 240B while the fusing belt 110 is being mounted (inserted) so as to cover the frame assembly 200. Thus, the end face of the fusing belt 110 can be prevented from getting stuck with the inner guide 240, thereby realizing smooth mounting of the fusing belt 110 onto the frame assembly 200. Damages to the fusing belt 110 at the time of assembly can therefore be restrained, thereby serving to prolongation of the service life of the fusing belt 110.

In the fixing device 100 thus produced, the lubricant G is continuously applied between each end face of the fusing belt 110 and corresponding one of the restricting surfaces 311A and 321A along the circumferential direction of the fusing belt 110. Therefore, the end faces of the fusing belt 110 can be prevented from being in direct contact with the restricting surfaces 311A and 321A from the beginning of the use of the fixing device 100. Further, in the lubricant application process, the applied lubricant G is flattened into an arcuate shape having a predetermined width. Hence, direct abutment between each end face of the fusing belt 110 and each restricting surface 311A or 321A can be prevented even if the circular movement of the fusing belt 110 causes the fusing belt 110 itself to move (displace) in the radial direction. As a result, occurrence of a crack on the end faces of the fusing belt 110 can be suppressed, thereby prolonging the service life of the fusing belt 110.

Various modifications are conceivable.

In the depicted embodiment, the inner guide 240 has the sloped surfaces 240B on both sides of the guide surface 240A in the axial direction, but the sloped surface 240B may be formed only inward of the guide surface 240A in the axial direction. Conceivably, when being fitted over the frame assembly 200, the fusing belt 110 (tubular member) can relatively easily go over the inner guide 240 provided at a near side (upstream) in a mounting direction of the fusing belt 110, since an angle of the fusing belt 110 at which the fusing belt 110 is inserted can be changed appropriately by tilting the fusing belt 110 at this time. However, as the fusing belt 110 is inserted deeper toward a far side (downstream) in the mounting direction, changing the angle of the fusing belt 110 becomes harder, thus increasing a possibility that the end face of the fusing belt 110 gets stuck with the inner guide 240 formed on the far side in the mounting direction. Nonetheless, the formation of the sloped surface 240B inward of the guide surface 240A in the axial direction can prevent the fusing belt 110 from being stuck with, especially, the inner guide 240 on the far side.

Further, although the inner guides 240 of the embodiment are formed adjacent to and inward of the respective end-face restricting members 300 in the axial direction, the inner guides 240 may be disposed away from the end-face regulating members 300. Still alternatively, more than three inner guides 240 may be provided at both end portions of the frame assembly 200 and a portion interposed therebetween.

Figure 10:
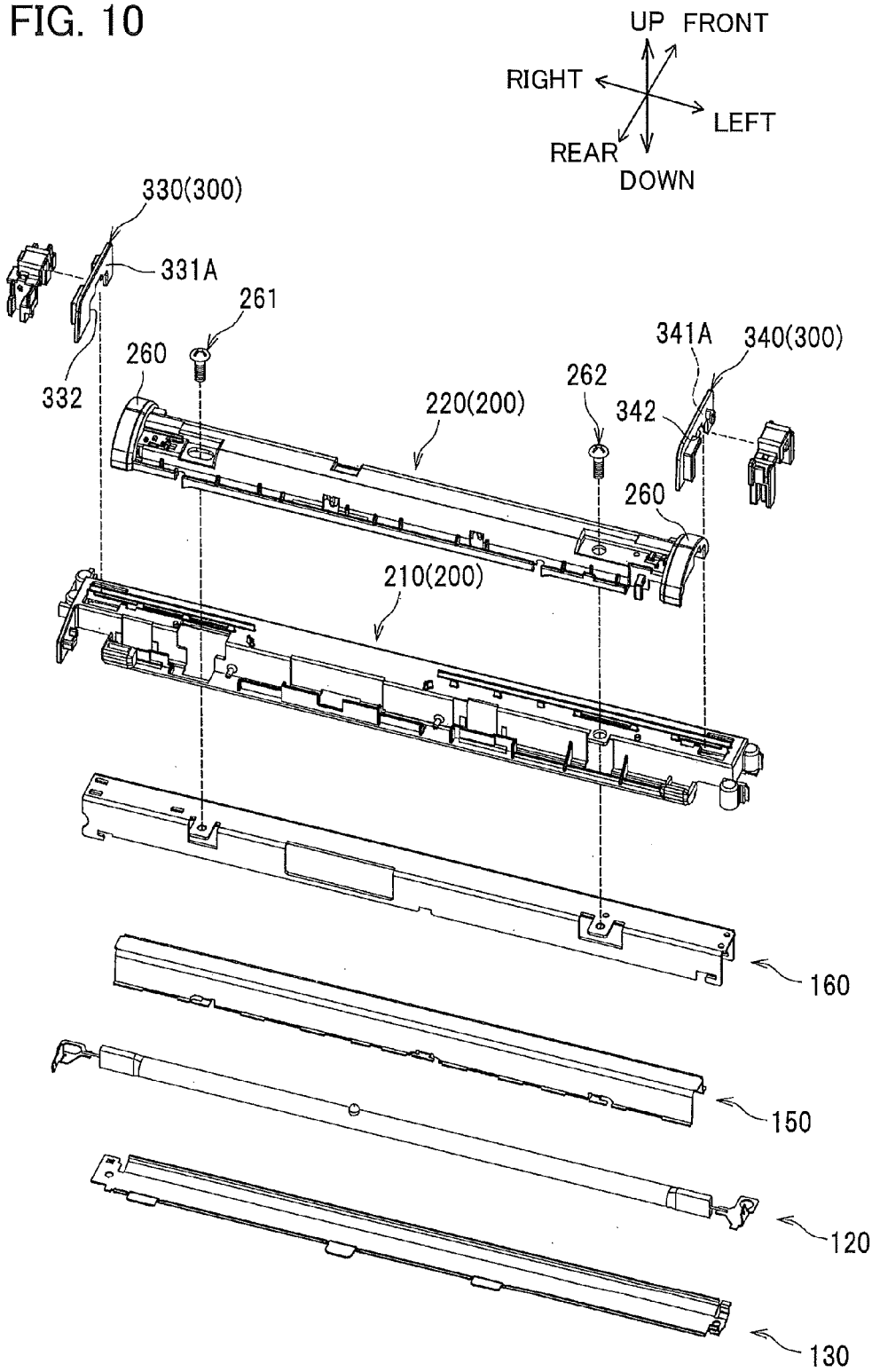
FIG. 10 is an exploded perspective view of a fixing device according to a first modification of the present invention.

As a further alternative to the inner guide 240 of the embodiment, FIG. 10 shows an inner guide 260 according to a first modification of the present invention. Instead of the inner guide 240 configured of the first guide 241 formed on the first frame 210 and the second guide 242 formed on the second frame 220, the inner guide 260 of the first modification is formed only on the second frame 220 that covers the first frame 210. Specifically, the inner guide 260 has a guide surface (shown without a reference numeral) that protrudes from the second frame member 220 to have a generally semi-circular arcuate shape in a side view. With this construction, the guide surface of the inner guide 260 can be formed in a seamless manner, so that the inner peripheral surface of the moving fusing belt 110 can be guided reliably.

With regard to the frame assembly 200, the frame assembly 200 of the embodiment is configured of two separate members (first frame member 210 and second frame member 220). However, the frame assembly 200 may be configured of a single member, or more than three separate members.

Further, the end faces of the base tube 111 of the fusing belt 110 (tubular member) are exposed in the embodiment, but the end faces of the base tube 111 may each be covered with a coating layer. Further, instead of a metal, the base tube 111 may be formed of a resin such as polyimide resin or a material having elasticity such as a rubber. Further, instead of the fusing belt 110 of the embodiment having a multi-layer structure configured of the base tube 111 and the coating layer 112, the fusing belt 110 may have a single-layer structure consisting solely of the base tube 111. Still alternatively, the inner peripheral surface of the base tube 111 may be covered with a coating layer.

In the above embodiment, the nip plate 130 and backup roller 140 are exemplified as the first fixing member and second fixing member, respectively. However, the first fixing member may be, for example, a member that is configured to guide the inner peripheral surface and support a ceramic heater as the heat source. The second fixing member may be a belt-like shaped backup member or a plate-like shaped backup member that does not rotate.

Further, the end-face restricting members 300 of the embodiment may also have other configurations. For example, a flange-like shaped member may serve as the end-face restricting members 300.

Figure 11:
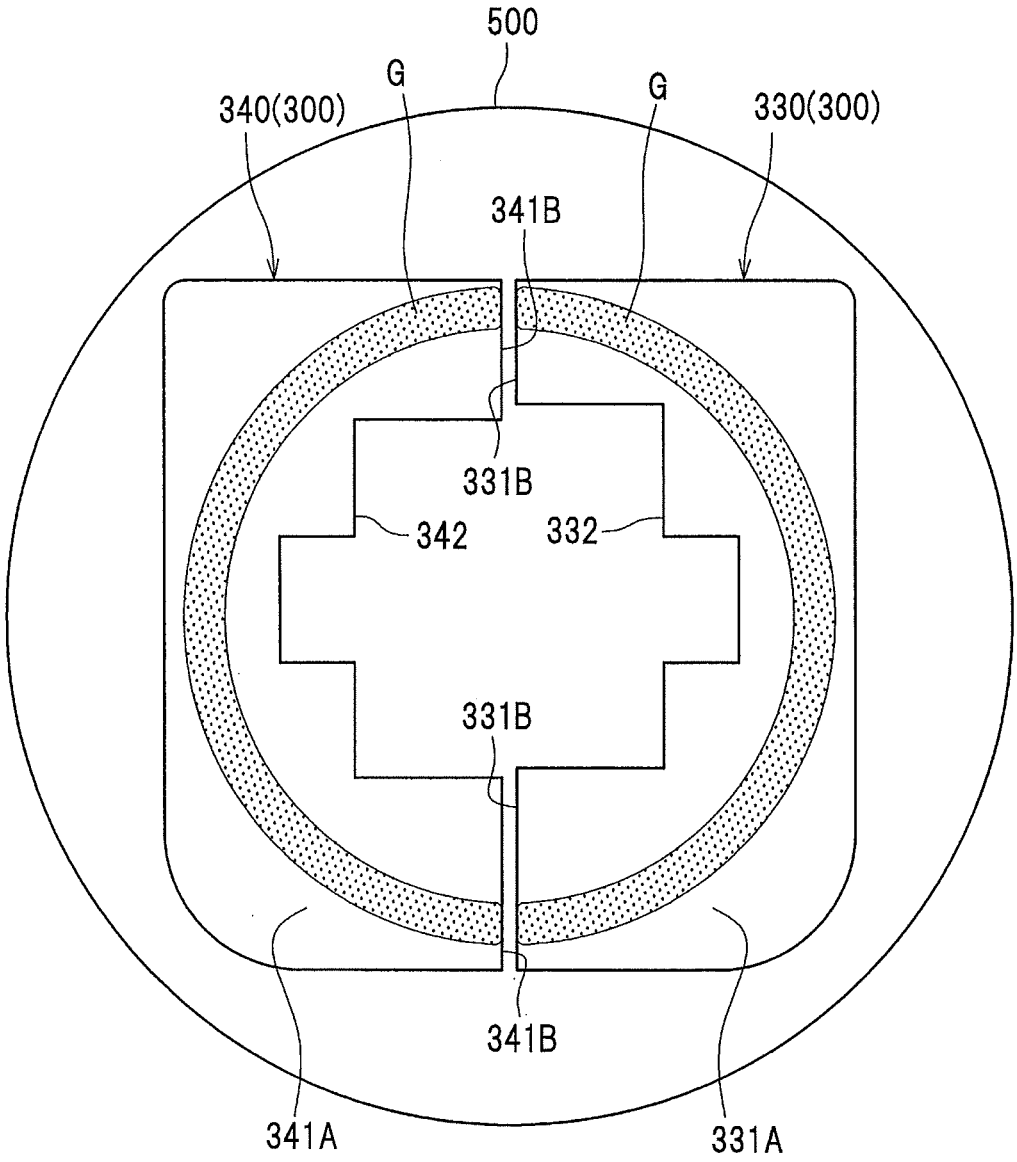
FIG. 11 is a plan view showing a state where right and left end-face restricting members according to a second modification of the present invention are placed in a jig and applied with a lubricant.

FIG. 11 shows a right end-face restricting member 330 and a left end-face restricting member 340 according to a second modification of the present invention. The right end-face restricting member 330 and the left end-face restricting member 340 are formed in a generally U-shape in a plan view, respectively. The right end-face restricting member 330 and the left end-face restricting member 340 have restricting surfaces 331A, 341A and engaged portions 332, 342 respectively. In the lubricant application process, when set in the jig 500, both the right end-face restricting member 330 and the left end-face restricting member 340 are placed such that the restricting surfaces 331A and 341A face upward and the engaged portions 332 and 342 oppose each other. At this time, the right end-face restricting member 330 and the left end-face restricting member 340 are positioned so as not to provide a large gap therebetween, the gap being formed by end faces 331B of the right end-face restricting member 330 and end faces 341B of the left end-face restricting member 340, as shown in FIG. 11. With this arrangement, the lubricant G can be efficiently applied to the restricting surfaces 331A and 341A.

In the production method (lubricant application process) of the fixing device 100 of the above embodiment, the paddle 620 functions to flatten the applied lubricant G, while the dispenser 610 applies the lubricant G onto the restricting surfaces 311A and 321A. However, other lubricant application methods are also available. For example, the application of the lubricant G and the flattening of the lubricant G may be performed separately, before the fusing belt 110 is assembled to the frame assembly 200. Specifically, firstly, the lubricant G may be continuously applied onto the restricting surfaces 311A and 321A along the circumferential direction of the fusing belt 110; and thereafter the applied lubricant G is flattened into an arcuate shape in a separate process. Still alternatively, before the end faces of the fusing belt 110 and the restricting surfaces 311A and 321A are arranged so as to face each other, the lubricant G may be applied onto the restricting surfaces 311A and 321A in a dot-like pattern, and thereafter the lubricant G applied onto the restricting surfaces 311A and 321A may be spread into an arcuate shape with a predetermined width in a separate process.

Further, the sheet S can be an OHP sheet instead of a plain paper and a postcard.

Further, in the depicted embodiment, the present invention is applied to the monochromatic laser printer 1 as an example of an image forming apparatus incorporating the fixing device 100 of the embodiment. However, a color laser printer, a copying machine and a multifunction device provided with a scanning device, such as a flat-head scanner are also available.

While the invention has been described in detail with reference to the embodiments thereof, it would be apparent to those skilled in the art that various changes and modifications may be made therein without departing from the spirit of the invention.

What is claimed is:

1. A fixing device comprising:

a flexible tubular member having an inner peripheral surface defining an internal space and an outer peripheral surface opposite to the inner peripheral surface, the flexible tubular member defining an axis extending in an axial direction and having end faces in the axial direction;

a first fixing member disposed in the internal space;

a second fixing member configured to nip the flexible tubular member in cooperation with the first fixing member;

a pair of restricting members disposed to interpose the flexible tubular member therebetween in the axial direction, each restricting member having a restricting surface abuttable with each end face of the flexible tubular member to restrict the flexible tubular member from moving in the axial direction;

a pair of inner guides each disposed inward of each of the pair of restricting members in the axial direction and configured to guide the inner peripheral surface of the flexible tubular member, each restricting member being a separate member from each inner guide; and a lubricant provided between each restricting surface and each end face of the flexible tubular member and between each inner guide and the inner peripheral surface of the flexible tubular member, the lubricant being also provided on each restricting surface at a position outward relative to the outer peripheral surface of the flexible tubular member in a radial direction perpendicular to the axial direction and being continuous with the lubricant provided between each restricting surface and each end face of the flexible tubular member, the lubricant being also provided between each restricting surface and a portion of each inner guide in the axial direction.

2. The fixing device as claimed in claim 1, wherein:

the flexible tubular member has a circumference defining a circumferential direction and has a thickness in the radial direction; and each restricting surface has a specific area continuously applied with the lubricant upon completion of assembly of the fixing device, the specific area having an arcuate shape extending in the circumferential direction and having a width in the radial direction, the arcuate shape having a central angle smaller than 180 degrees.

3. The fixing device as claimed in claim 2, wherein the width of the specific area is defined as a range within which each end face of the flexible tubular member is possibly abuttable with each restricting surface while the flexible tubular member circularly moves.

4. The fixing device as claimed in claim 2, wherein the width of the specific area is in a range of 4.0 to 4.5 mm.

5. The fixing device as claimed in claim 1, wherein the flexible tubular member comprises a base tube made of a metal.

6. The fixing device as claimed in claim 5, wherein the base tube has an outer peripheral surface; and wherein the flexible tubular member further comprises a coating layer provided on the outer peripheral surface of the base tube.

7. The fixing device as claimed in claim 6, wherein the base tube has base end faces in the axial direction that are not covered with the coating layer.

8. The fixing device as claimed in claim 1, wherein the restricting surfaces are formed as a flat surface without irregularity.

9. The fixing device as claimed in claim 1, wherein each inner guide is disposed adjacent to each restricting member in the axial direction.

10. The fixing device as claimed in claim 1, wherein each inner guide comprises:

a guide surface configured to guide the inner peripheral surface of the flexible tubular member; and a sloped surface positioned outward of the guide surface in the axial direction, the sloped surface sloping away from the inner peripheral surface toward the restricting surface, the lubricant being provided between each restricting surface and each sloped surface.

11. The fixing device as claimed in claim 10, wherein each inner guide is disposed adjacent to and inward of each restricting surface in the axial direction, and wherein each restricting surface and each sloped surface define a V-shaped cross-section to retain the lubricant.

12. The fixing device as claimed in claim 1, wherein the first fixing member and the second fixing member are configured to nip the flexible tubular member therebetween to form a nip region where a sheet is conveyed in a sheet conveying direction, and wherein each restricting surface comprises an upstream portion and a downstream portion positioned opposite to each other with respect to the nip region in the sheet conveying direction, wherein a surface area of the upstream portion is different than a surface area of the downstream portion.

13. The fixing device as claimed in claim 12, wherein the surface area of the downstream portion is larger than the surface area of the upstream portion.

14. The fixing device as claimed in claim 1, wherein each restricting member further comprises an opposite surface opposite to the restricting surface in the axial direction and an end face connecting the restricting surface and the opposite surface, the lubricant being further provided on the end face.

15. The fixing device as claimed in claim 1, wherein each inner guide comprises:

a guide surface configured to guide the inner peripheral surface of the flexible tubular member, the lubricant being provided between each restricting surface and each guide surface;

a first sloped surface positioned outward of the guide surface in the axial direction, the first sloped surface sloping away from the inner peripheral surface toward each restricting surface, the lubricant being provided between each restricting surface and each first sloped surface; and a second sloped surface positioned inward of the guide surface in the axial direction, the second sloped surface sloping away from the inner peripheral surface toward the axis of the flexible tubular member.

* * * * *